US011856984B2

(12) United States Patent
Fisten

(10) Patent No.: US 11,856,984 B2
(45) Date of Patent: Jan. 2, 2024

(54) CIGAR CUTTERS

(71) Applicant: VPR Brands, LP, Ft Lauderdale, FL (US)

(72) Inventor: Douglas Fisten, Miami, FL (US)

(73) Assignee: VPR Brands, LP, Sunrise, FL (US)

( * ) Notice: Subject to any disclaimer, the term of this patent is extended or adjusted under 35 U.S.C. 154(b) by 41 days.

(21) Appl. No.: 17/384,394

(22) Filed: Jul. 23, 2021

(65) Prior Publication Data

US 2023/0021505 A1 Jan. 26, 2023

(51) Int. Cl.
*A24F 13/24* (2006.01)
*A24F 13/26* (2006.01)

(52) U.S. Cl.
CPC ..... *A24F 13/26* (2013.01)

(58) Field of Classification Search
CPC ..... A24F 13/26
USPC ..... 30/113, 111, 112; 131/248, 250, 253
See application file for complete search history.

(56) References Cited

U.S. PATENT DOCUMENTS 3,903,598 A * 9/1975 Lefebvre ..... A24F 13/26 30/112
5,190,770 A * 3/1993 Tashiro ..... B26D 5/08 425/142
5,694,691 A * 12/1997 Chen ..... A24F 13/26 30/112
5,974,668 A * 11/1999 Butzer ..... A24F 13/24 30/279.2
5,975,668 A 11/1999 Butzer
D757,359 S * 5/2016 Van Keppel ..... D27/195
2008/0178469 A1* 7/2008 Gutman ..... A24F 13/26 30/299
2009/0082127 A1 3/2009 Donne
2017/0231271 A1 8/2017 Almsberger et al.
2020/0375247 A1 12/2020 Marshall et al.

FOREIGN PATENT DOCUMENTS

FR 333961 7/1903
FR 573811 3/1923
TW 301865 U 4/1997

OTHER PUBLICATIONS

European Patent Office, "Extended European Search Report", issued in connection with European Application No. 22160044.8, dated Jul. 15, 2022, 8 pages.
Intellectual Property Office of the Ministry of Economic Affairs, "Notice of Review Opinion," issued in connection with Taiwanese Patent Application No. 111109613, dated Jun. 6, 2023, 24 Pages. (English Machine Translation).

(Continued)

*Primary Examiner* — Phong H Nguyen
(74) *Attorney, Agent, or Firm* — Hanley, Flight & Zimmerman, LLC

(57) ABSTRACT

A cigar cutter includes a body having an opening to receive a cigar, and a first blade and a second blade that are moveable relative to the opening in the body. The first and second blades are moveable between an open position and a closed position. The cigar cutter also includes a wheel rotatably coupled to the body. When the wheel is rotated in a first direction, the first and second blades are moved to the open position, and when the wheel is rotated in a second direction opposite the first direction, the first and second blades are moved to the closed position.

14 Claims, 7 Drawing Sheets

(56) References Cited

OTHER PUBLICATIONS

Intellectual Property Office of the Ministry of Economic Affairs, "Patent Application Search Report," issued in connection with Taiwanese Patent Application No. 111109613, dated Jun. 5, 2023, 2 Pages. (English Machine Translation).
Canadian Intellectual Property Office, "Examination Search Report," issued in connection with CA Patent Application No. 3,161,461, dated Aug. 22, 2023, 5 pages.

* cited by examiner

CIGAR CUTTERS

FIELD OF THE DISCLOSURE

This disclosure relates generally to smoking accessories and, more particularly, to cigar cutters.

BACKGROUND

A cigar cutter is a device for cutting the cap or end of a cigar so that a user can draw air through the cigar and thus "smoke' the cigar. Cigars are made of leaves of tobacco that are usually rolled into cylindrical shapes. There are figurado shapes such as Torpedos and Perfectors as well as boxed pressed cigars. All premium cigars no matter the shape have a closed cap or head that needs to be cut. The other end referred to the "foot" of the cigar is cut during the manufacturing process and open to air flow.

BRIEF DESCRIPTION OF THE DRAWINGS

In FIG. 6, an example first plate of an example body of the example cigar cutter has been removed.

In FIG. 7, the example first plate and an example first wheel plate of the example cigar cutter have been removed.

In FIG. 10, an example second plate of the example body of the example cigar cutter has been removed.

In FIG. 11, the example second plate and an example second wheel plate have been removed.

Figure 2:
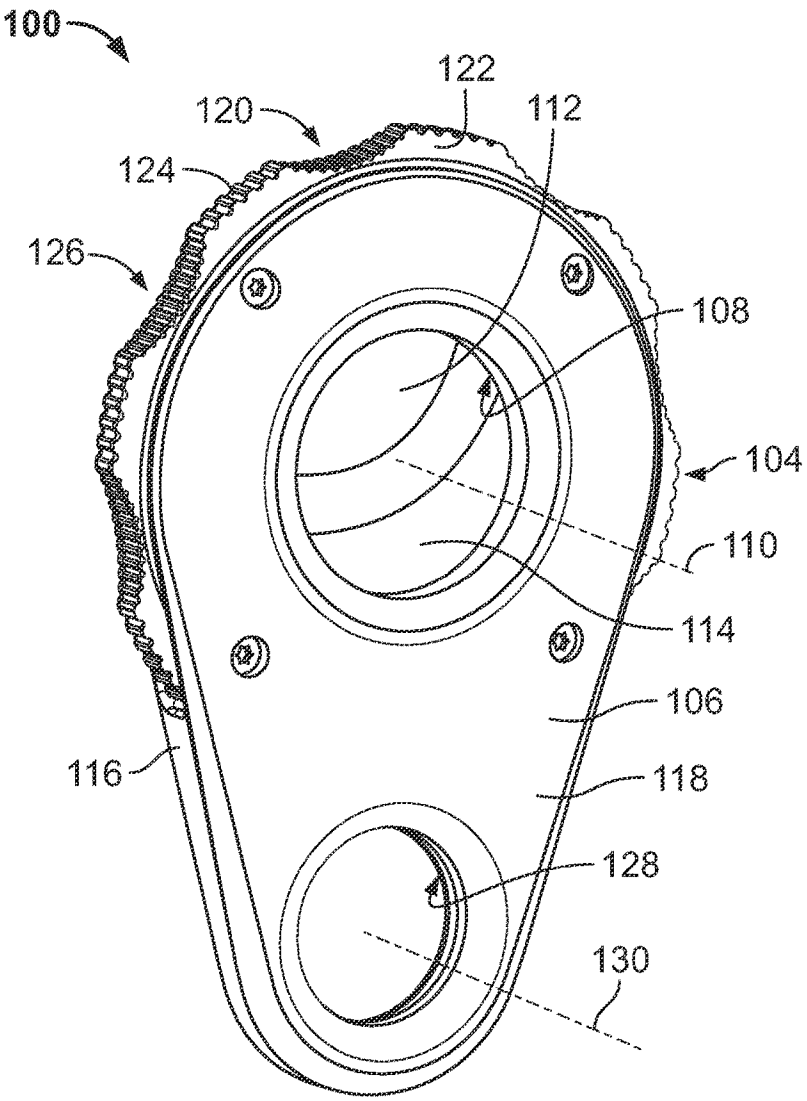
FIG. 2 is a perspective view of a second side of the example cigar cutter of FIG. 1.

The figures are not necessarily to scale. Instead, the thickness of the layers or regions may be enlarged in the drawings. Although the figures show layers and regions with clean lines and boundaries, some or all of these lines and/or boundaries may be idealized. In reality, the boundaries and/or lines may be unobservable, blended, and/or irregular. In general, the same reference numbers will be used throughout the drawing(s) and accompanying written description to refer to the same or like parts.

As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other.

Unless specifically stated otherwise, descriptors such as "first," "second," "third," etc., are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name.

DETAILED DESCRIPTION

Disclosed herein are example cutters or cutting devices, referred to herein as cigar cutters, that include example cutting means such as, for example, example blades. The blades may be used to cut through a cigar, such as for cutting off the end of the cigar. The example cutters or cutting devices disclosed herein can also be used for cutting other smoking products, such as cigarettes. Also, the examples disclosed herein can be used for cutting other objects, such as food (e.g., fruits, vegetables, etc.), rope, and/or any other object that can be inserted into the opening of the cutter or cutting device.

Known cigar cutters typically include two handles that are connected to blades. The handles are moveable in a linear direction toward or away from each other. A user can insert his/her fingers into the handles and move the handles toward or away from each other, thereby moving the blades in a linear direction to provide a cutting action.

Example cigar cutters disclosed herein include a rotatable actuation mechanism that can be used to open and close the blades. As used herein, rotating includes movements along an arc and/or about a central axis of an object or a non-central axis. Rotational movement can include movement about a pivot. For example, an example cigar cutter disclosed herein include a body having an opening to receive a cigar and one or more blades that are moveable relative to the opening. In some examples, the rotatable actuation mechanism includes a wheel that is rotatably coupled to the body. The wheel can be rotated in a first direction to move the blades away from each other to an open position, or the wheel can be rotated in a second direction (opposite the first direction) to move the blades toward each other to a closed position. For example, a user can rotate the wheel in the first direction to open the blades and then insert a cigar into the opening. Then, the user can rotate the wheel in the second direction, which causes the blades to move toward each other to provide the cutting action to cut the cigar. In some examples, the blades are rotatably coupled to the body. When the wheel is rotated in the first direction, the wheel rotates the blades away from each other to the open position, and when the wheel is rotated in the second position, the wheel rotates the blades toward each other to the closed position.

In some examples, the actuation mechanism is biased in a direction to move the blades to the closed position. For examples, the cigar cutter can include biasing means or a biasing element such as, for example, a spring, to bias the wheel in the second direction, thereby automatically closing the blades. Therefore, the user can rotate the wheel in the first direction to open the blades, and then release the wheel, which automatically rotates the wheel (via the spring force) in the second direction to close the blades and provide the cutting action. Some known linear actuating cigar cutters include springs, but the springs are configured to assist in opening the handles and the blades. Therefore, when closing the blades of the traditional cigar cutters, a user has to overcome or work against the force of the springs. The example cigar cutters disclosed herein utilize a spring that biases the blades to the closed position, thereby assisting in the cutting force. In some examples, the spring provides sufficient force to the blades to cut through the cigar. In other examples, the user may still provide some force on the wheel to assist in the cutting action. In the examples disclosed herein, the resting position, based on the biasing force of the spring, is the closed position. In some examples, the blades overlap in the closed position. This provides a safety feature because user force is needed to open the cigar cutter and exposed the cutting edge of the blades.

In some examples disclosed herein, the cigar cutter includes a stabilization feature to help stabilize the cigar cutter while cutting and perform a straight and precise cut. For example, the cigar cutter can include a second opening formed in the body of the cigar cutter. A user can insert one or more of his/her finger(s) through the opening to help hold and stabilize the body while interacting with the rotatable actuation mechanism.

Figure 1:
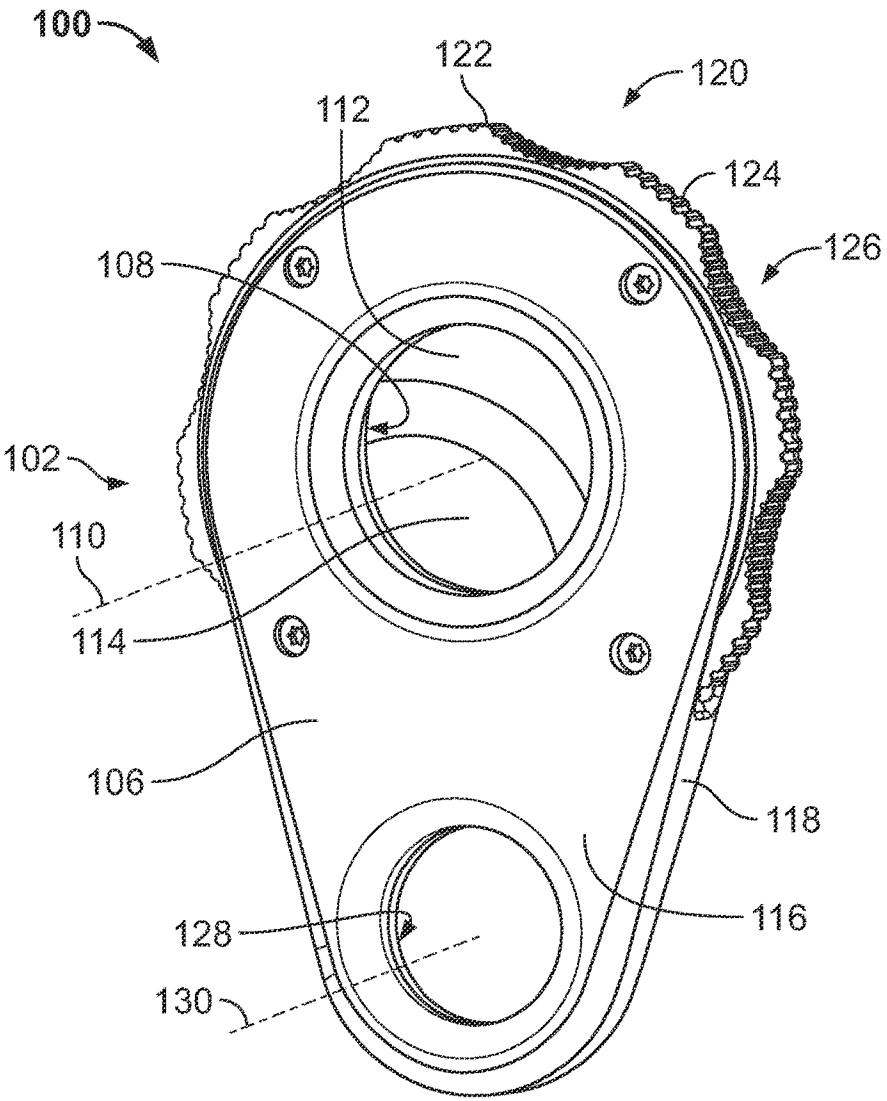
FIG. 1 is a perspective view of a first side of an example cigar cutter with example blades in a closed position.

FIGS. 1 and 2 illustrate an example cigar cutter 100 constructed in accordance with the teachings of this disclosure. FIG. 1 shows a first side 102 of the cigar cutter 100, and FIG. 2 shows a second side 104 of the cigar cutter 100 opposite the first side 102. In the illustrated example, the cigar cutter 100 includes a body 106 (e.g., a housing), which can be held in the hand of a user when using the cigar cutter 100. The body 106 can be constructed of one or more parts or components. The body 106 has an opening 108 extending through the body 106 from the first side 102 to the second side 104. In the illustrated example, the opening 108 is closed by one or more blades, disclosed in further detail herein. The opening 108 is to receive a cigar when it is desired to cut the cigar. The opening 108 has a central axis 110. The central axis 110 is perpendicular to a plane of the body 106.

The example cigar cutter 100 includes at least one blade. In some examples, the example cigar cutter 100 includes two or more blades. In the illustrated example of FIGS. 1 and 2, the cigar cutter 100 includes a first blade 112 and a second blade 114. The first and second blades are moveable relative to the opening 108 in the body 106. The first and second blades 112, 114 are moveable toward and away from each other to provide a cutting action. In particular, the blades 112, 114 are moveable between a closed position and an open position. In FIGS. 1 and 2, the blades 112, 114 are shown in the closed position. In the closed position, the blades 112, 114 are disposed in and substantially cover or fully block the opening 108. When moved to the open position, the blades 112, 114 move apart, such that a cigar can be inserted through the opening 108 and between the blades 112, 114 (examples of the blades 112, 114 in the open position are shown in other figures). The blades 112, 114 can then be moved toward each other to the closed position to cut the cigar.

In the illustrated example of FIGS. 1 and 2, the body 106 includes a first plate 116 (e.g., a first portion) forming the first side 102 of the body 106 and a second plate 118 (e.g., a second portion) forming the second side 104 of the body 106. The first and second plates 116, 118 are rigidly coupled. In some examples, the first and second plates 116, 118 are coupled via one or more fasteners (e.g., screws, bolts, rivets, etc.). Additionally or alternatively, the first and second plates 116, 118 can be coupled via one or more other coupling techniques, such as, for example, an adhesive (e.g., glue), one or more latches, a press fit, and/or a friction fit.

To move the blades 112, 114 between the open and closed positions, the cigar cutter 100 includes an example actuation mechanism 120. A user can interact with the actuation mechanism 120 to open and/or close the blades 112, 114. In this example, the actuation mechanism 120 includes a rotatable disk or wheel 122, which may also be referred to as a roller. The wheel 122 can be rotated in a first direction to cause the blades 112, 114 to move away from each other to the open position, and the wheel 122 can be rotated in a second direction (opposite the first direction) to cause the blades 112, 114 to move toward each other to the closed position. The wheel 122 is rotatably coupled to the body 106. The wheel 122 is coaxial with and rotatable about the central axis 110. In some examples, to use the cigar cutter 100, a user may hold the body 106 between his/her palm and one or more fingers (e.g., ring and pinky fingers). The user may then use his/her one or more other fingers (e.g., thumb, pointer, and middle fingers) to rotate the wheel 122. In other examples, the cigar cutter 100 can be held and/or operated in other configurations.

In the illustrated example, the wheel 122 is disposed between the first and second plates 116, 118. The wheel 122 has an outer peripheral edge 124. A portion of the outer peripheral edge 124 extends beyond the body 106. The user can interact with the wheel 122 by gripping the outer peripheral edge 124 and rotating the wheel 122. In the illustrated example, the outer peripheral edge 124 has a plurality of grooves 126 (one of which is referenced in FIGS. 1 and 2). In some examples, there is only one groove. In some examples, the grooves 126 enable a user to better grip the wheel 122. In some examples, the grooves 126 are spaced equidistant around the outer peripheral edge 124. Additionally or alternatively, the outer peripheral edge 124 can be ribbed. In other examples, the wheel 122 may not include grooves or ribs.

Figure 4:
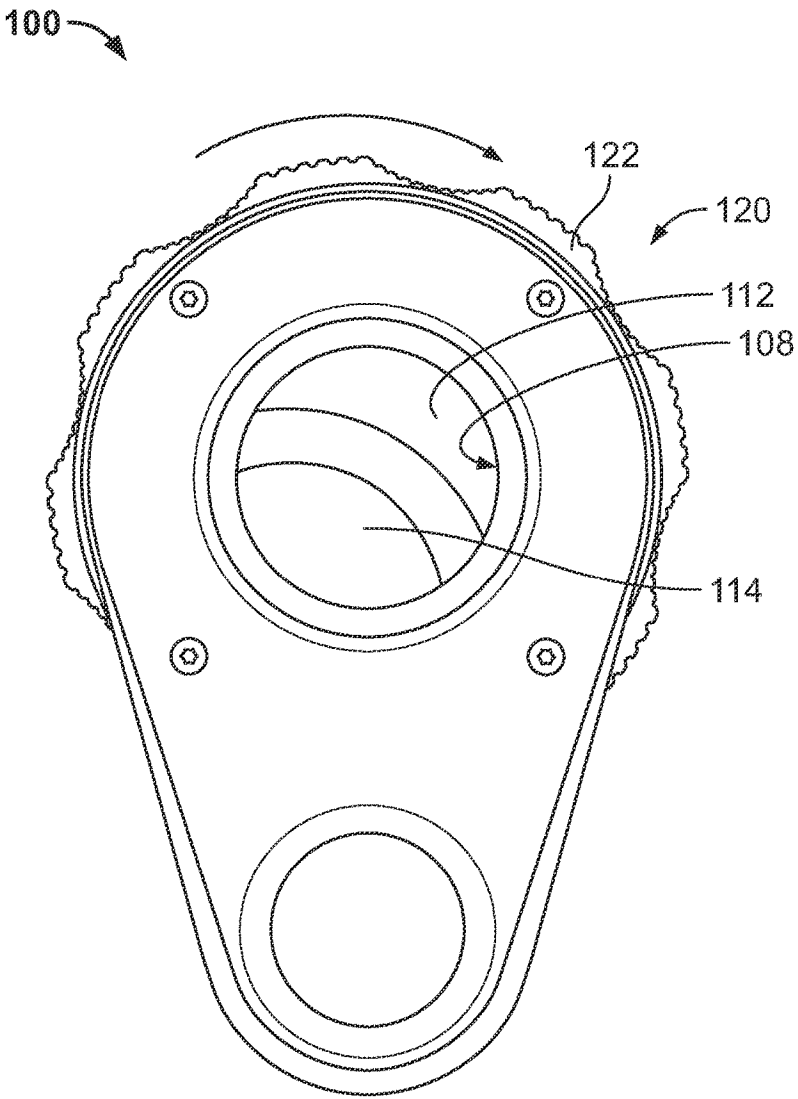
FIG. 4 is a side view of the first side of the example cigar cutter of FIG. 1 with the example wheel rotated in a second direction to move the example blades to the closed position.
Figure 3:
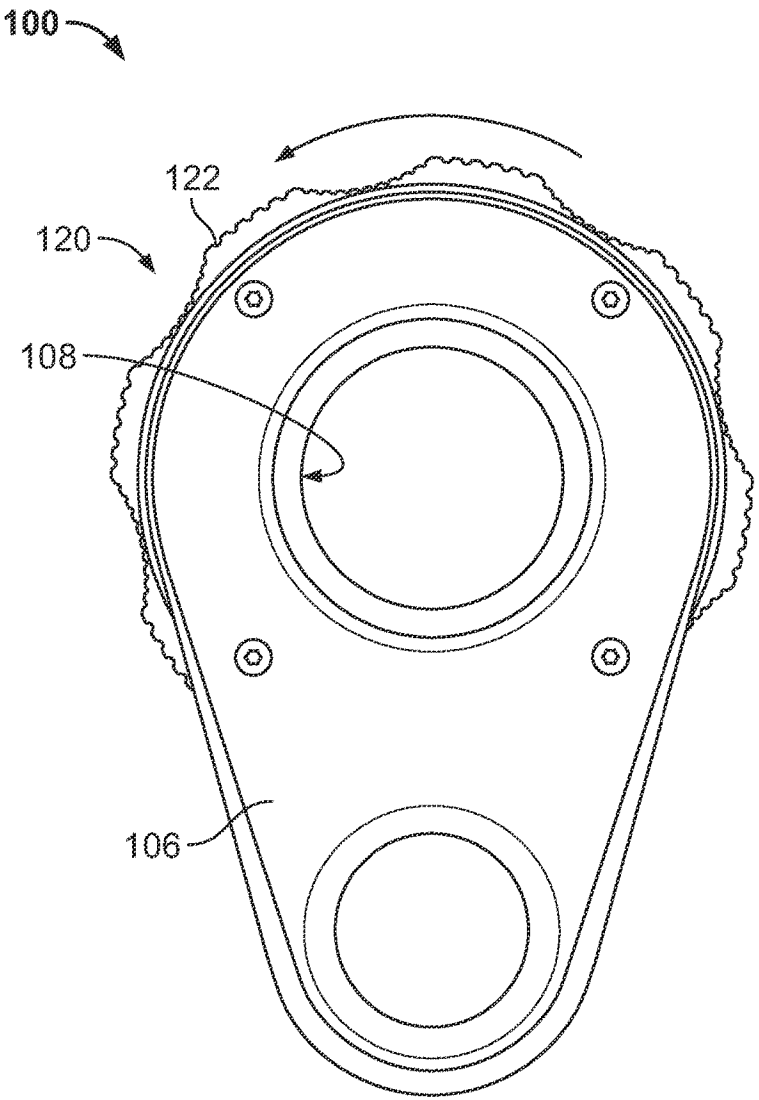
FIG. 3 is a side view of the first side of the example cigar cutter of FIG. 1 with an example wheel rotated in a first direction to move the example blades to an open position.

In some examples, when the wheel 122 is rotated in one direction, the blades 112, 114 are moved apart from each other to the open position, and when the wheel 122 is rotated in the opposite direction, the blades 112, 114 are moved toward each other to the closed position. For example, FIGS. 3 and 4 show the blades 112, 114 in the open and closed positions, respectively. In FIG. 3, the wheel 122 has been rotated in the first direction (as shown by the direction of the arrow), which moves the blades 112, 114 (not seen in FIG. 3) away from each other to the open position. In the open position, the blades 112, 114 are retracted into the body 106. In some examples, when the blades 112, 114 are in the open position, no portion of the blades 112, 114 extend into the opening 108. In other examples, when the blades 112, 114 are in the open position, a portion of the blades 112, 114 may extend into the opening 108. In FIG. 4, the wheel 122 has been moved in the second direction (as shown by the direction of the arrow), opposite the first direction, which moves the blades 112, 114 toward each other and into the opening 108. In this example, when the blades 112, 114 are in the closed position, the blades 112, 114 overlap in the axial direction (aligned with the central axis 110 (FIG. 1). In some examples, the blades 112, 114 slide along each other.

In some examples, the actuation mechanism 120 includes one or more stops or limits to prevent the wheel 122 from rotating beyond a certain point, such that the wheel 122 cannot be rotated beyond the open and closed positions (also referred to as fully open and fully closed positions). The wheel 122 can be rotated to any position between the fully open and fully closed positions, such that the blades 112, 114 can be partially open or closed. In some examples, when the wheel 122 is stopped, the blades 112, 114 remain in the same position. Therefore, the use can rotate the wheel 122 to a desired position of the blades 112, 114.

In some examples, the actuation mechanism 120 is spring-loaded to bias the wheel 122 and the blades 112, 114 to one position. For example, the actuation mechanism 120 can be spring-loaded to bias the wheel 122 to the closed position. Therefore, if the user rotates the wheel 122 in the first direction (which move the blades 112, 114 to the open position) and releases the wheel 122, the wheel 122 automatically rotates in the second direction to move the blades 112, 114 to the closed position. This may be advantageous because a user does not need to apply the cutting force. Instead, the user only has to rotate the wheel 122 in the first direction to open the blades 112, 114 and then release the wheel 122. In some examples, the spring-loaded force provides sufficient force to move the blades 112, 114 together to cut through the cigar. This reduces or eliminates the force needed by the user to cut the cigar. This can be advantageous for users with weaker grips (e.g., a user suffering from arthritis in the hands) that may otherwise not be able to provide sufficient cutting force. In other examples, the user may provide some force in addition to or alternative to the spring force to rotate the wheel 122 in the second direction.

Referring back to FIGS. 1 and 2, the body 106 has an opening 128 (e.g., a second opening) extending through the body 106 from the first side 102 to the second side 104. In some examples, the opening 128 can be used to receive a finger of a user while holding the cigar cutter 100. For example, the user may insert his/her ring finger into the opening 128, and use his/her thumb, pointer, and/or middle fingers to rotate the wheel 122. The ring finger in the opening 128 helps prevent the cigar cutter 100 from rotating or otherwise shifting in the user's hand, thereby stabilizing the cigar cutter 100 to ensure a straight and precise cut. In the illustrated example, the opening 128 is circular. However, in other examples, the opening 128 can have a different shape (e.g., an oval, a square, a triangle, etc.). In this example, the opening 128 is smaller than the opening 108. In other examples, the opening 128 can be larger than the opening 108. In the illustrated example, the opening 128 has a central axis 130 that is parallel to and offset from the central axis 110 of the opening 108. In other examples, the cigar cutter 100 may not include the opening 128.

Figure 5:
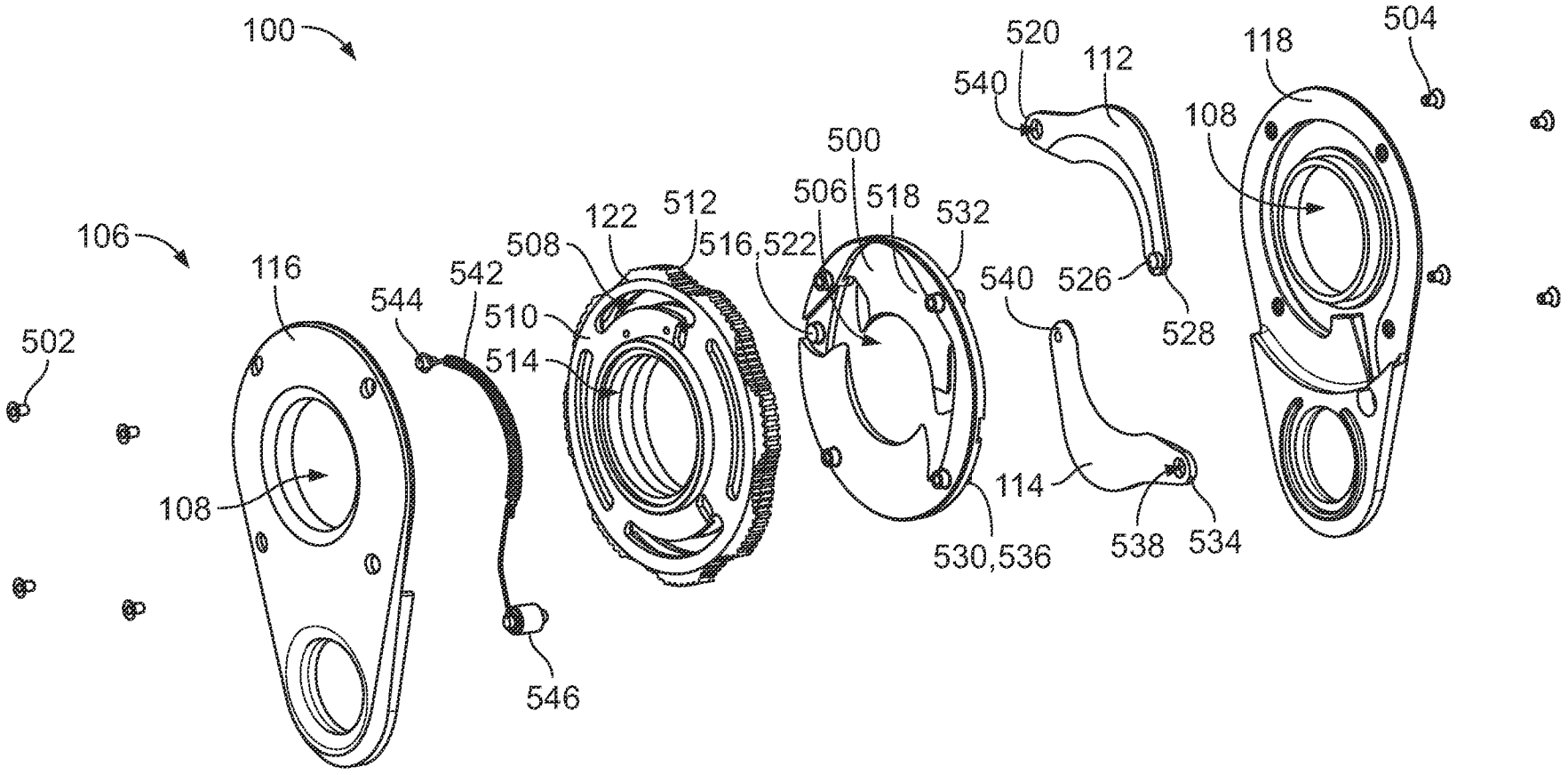
FIG. 5 is an exploded view of the example cigar cutter of FIG. 1.

FIG. 5 is an exploded view of the example cigar cutter 100. In the illustrated example, the cigar cutter 100 includes a mounting plate 500. When the cigar cutter 100 is assembled, the mounting plate 500 is coupled to and fixed relative to the body 106 (formed by the first and second plates 116, 118). For example, in FIG. 5, the cigar cutter 100 includes a first threaded fasteners 502 (one of which is referenced in FIG. 5). When the cigar cutter 100 is assembled, the first threaded fasteners 502 extend through the first plate 116 and into the mounting plate 500, thereby non-rotatably coupling the mounting plate 500 and the first plate 116. Similarly, the cigar cutter 100 includes a second threaded fasteners 504 (one of which is referenced in FIG. 5) that extend through the second plate 118 and into the mounting plate 500 to non-rotatably couple the mounting plate and the second plate 118. In this example, the first and second threaded fasteners 502, 504 include four (4) threaded fasteners. In other examples, the cigar cutter 100 can include more or fewer threaded fasteners. The mounting plate 500 has an opening 506 that is aligned with the opening 108 in the first and second plates 116, 118.

When the cigar cutter 100 is assembled, the wheel 122 is disposed between the first and second plates 116, 118. Further, when the cigar cutter 100 is assembled, the mounting plate 500 is disposed within the wheel 122, and the wheel 122 is rotatable around/about the mounting plate 500. As shown in FIG. 5, the wheel 122 includes arc shaped slots 508 (one of which is referenced in FIG. 5) extending between first and second sides 510, 512 of the wheel 122. The slots 508 on the first side 510 receive respective ones of the first threaded fasteners 502, and the slots 508 on the second side 512 receive respective ones of the second threaded fasteners 504. For example, when the cigar cutter 100 is assembled, the threaded fasteners 502, 504 extend through respective ones of the slots 508 and into opposite sides of the mounting plate 500. The slots 508 enable the wheel 122 to rotate relative to the mounting plate 500 without abutting the threaded fasteners 502, 504 that couple the plates 116, 118, 500. As shown in FIG. 5, the wheel 122 has an opening 514 that is aligned with the opening 108 in the first and second plates 116, 118 and the opening 506 in the mounting plate 500.

When the cigar cutter 100 is assembled, the first blade 112 is pivotably or rotatably coupled to the mounting plate 500 at a first point 516. Therefore, the first blade 112 is rotatably coupled to the body 106 (via the mounting plate 500). In this example, the first point 516 is on a first side 518 of the mounting plate 500. The first blade 112 is rotatably coupled to the mounting plate 500 at or near a first end 520 of the first blade 112. In the illustrated example, the mounting plate 500 has a first post 522 (e.g., a pin, a peg, etc.) (which defines the first point 516) extending from the first side 518. When the cigar cutter 100 is assembled, the first post 522 extends through an opening 524 in the first blade 112 at or near the first end 520 of the first blade 112. The first blade 112 is rotatable about the first post 522. In the illustrated example, the first blade 112 has a first post 526 at or near a second end 528 of the first blade 112 opposite the first end 520. When the cigar cutter 100 is assembled, the first post 526 is coupled to the wheel 122. As such, when the wheel 122 is rotated, the wheel 122 moves the second end 528, thereby rotating the first blade 112 about the first post 522 at the first point 516. Thus, the first post 522 forms a pivot point.

When the cigar cutter 100 is assembled, the second blade 114 is pivotably or rotatably coupled to the mounting plate 500 at a second point 530. Therefore, the second blade 114 is rotatably coupled to the body 106 (via the mounting plate 500). In this example, the second point 530 is on a second side 532 of the mounting plate 500 opposite the first side 518. The second blade 114 is rotatably coupled to the mounting plate 500 at or near a first end 534 of the second blade 114. In the illustrated example, the mounting plate 500 has a second post 536 (e.g., a pin, a rod, a shaft) (which defines the second point 530) extending from the second side 532. When the cigar cutter 100 is assembled, the second post 536 extends through an opening 538 in the second blade 114 at or near the first end 534 of the second blade 114. The second blade 114 is rotatable about the second post 536. Similar to the first blade 112, the second blade 114 has a post (shown in FIG. 10) at or near a second end 540 of the second blade 114 opposite the first end 534. When the cigar cutter 100 is assembled, the post is coupled to the wheel 122. As such, when the wheel 122 is rotated, the wheel 122 moves the second end 540, thereby rotating the second blade 114 about the second post 536 at the second point 530. Thus, the second post 536 forms a pivot point. The first and second blades 112, 114 are oppositely arranged, such than when the wheel 122 is rotated the first and second blades 112, 114 move (e.g., rotate) in opposite directions of each other.

In the illustrated example, the cigar cutter 100 includes a spring 542. In some examples, the spring 542 is configured to bias the wheel 122 in the second direction and, thus, bias the blades 112, 114 to the closed position. When the cigar cutter 100 is assembled, the spring 542 is coupled between a first mount 544 (e.g., a post, a peg, etc.) that is coupled to the wheel 122 and a second mount 546 that is coupled to the body 106 (e.g., to at least one of the first or second plates 116, 118). Therefore, when the wheel 122 is rotated in one direction, the spring 542 is expanded or stretched. When the wheel 122 is released, the tension in the spring 542 contracts and rotates the wheel 122 in the opposite direction, thereby closing the blades 112, 114. In this example, the spring 542 is a tension coil spring. However, in other examples, the spring 542 can be implemented as a compression spring. Further, in other examples, the spring 542 can be implemented by another type of spring, such as, for example, a flat spiral spring, sometimes referred to as a flat coil spring or a clock spring.

Figure 6:
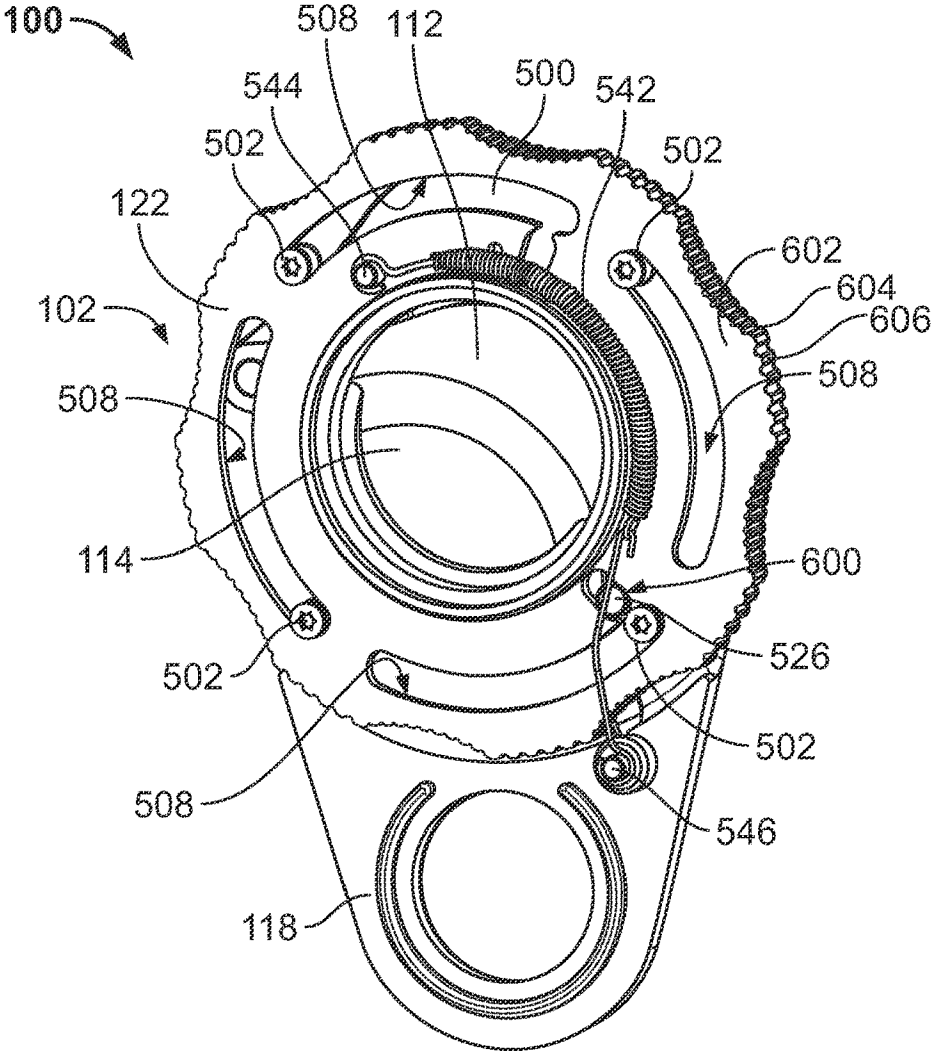
FIG. 6 is a perspective view of the first side of the example cigar cutter of FIG. 1 with the example blades in the closed position.

FIG. 6 shows the first side 102 of the cigar cutter 100 with the first plate 116 (FIG. 1) removed. In FIG. 6, the blades 112, 114 are in the closed position. As shown in FIG. 6, the first threaded fasteners 502 extend through respective ones of the slots 508 in the wheel 122 and into the mounting plate 500 (which is disposed in the wheel 122). In the illustrated example, the first threaded fasteners 502 are engaged with the ends of the slots 508. In some examples, engagement of the first threaded fasteners 502 with the ends of the slots 508 coincides with and/or defines the limit of the closed position. In particular, this engagement prevents the wheel 122 from being rotated further in the clockwise (second) direction in FIG. 6.

As shown in FIG. 6, the spring 542 is coupled between the first mount 544 on the wheel 122 and the second mount 546 that is coupled to the first and/or second plates 116, 118. The spring 542 biases the wheel 122 in the clockwise (second) direction in FIG. 6. In the illustrated example, the first post 526 of the first blade 112 is disposed in a first notch 600 formed in the wheel 122. When the wheel 122 rotates, the wheel 122 moves the first post 526 (e.g., along an arcuate path), such that the first blade 112 is rotated about the first point 516. In other examples, the first blade 112 can be coupled to the wheel 122 in other manners (e.g., a threaded fastener, friction fit, an adhesive, etc.).

In some examples, the wheel 122 is constructed of three parts or components, including a first wheel plate 602, a second wheel plate 604, and a ring 606 between the first and second wheel plates 602, 604. In other examples, the wheel 122 can be constructed of more or fewer parts or components. In some examples, the ring 606 can be integral to one of the wheel plates 602, 604. In some examples, the wheel 122 can be constructed of two half sections (e.g., similar to the first and second plates 602, 604) that are coupled.

Figure 7:
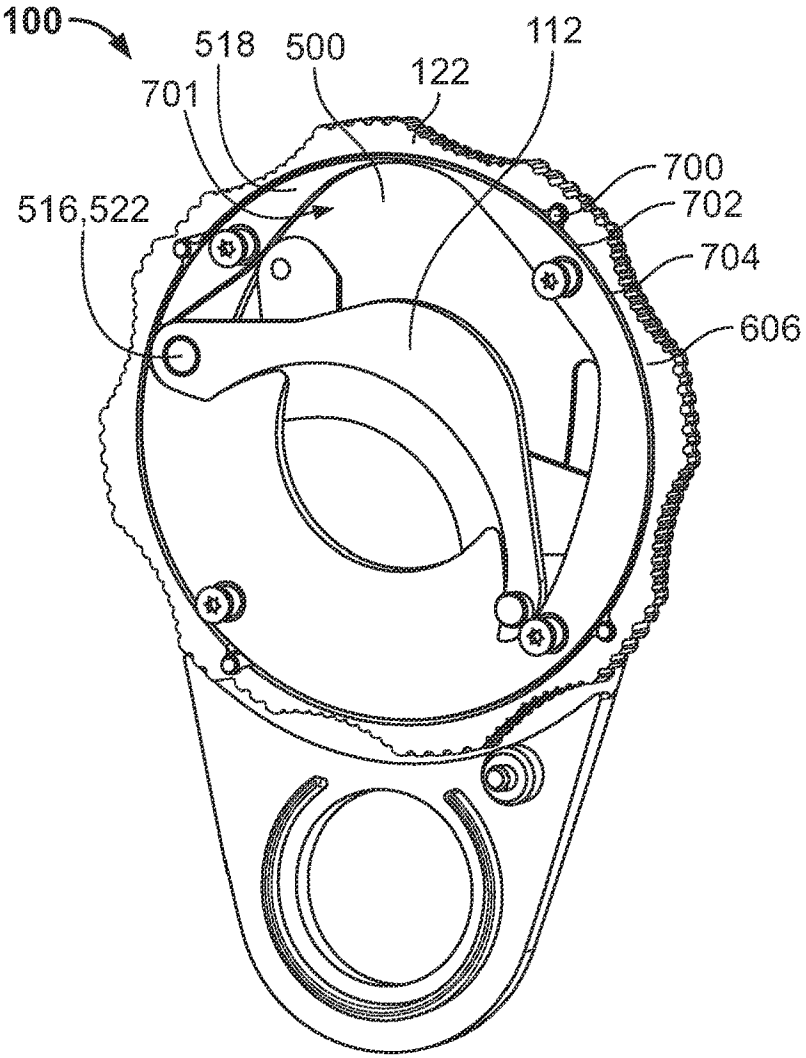
FIG. 7 is a perspective view of the first side of the example cigar cutter of FIG. 1 with the example blades in the closed position.
Figure 9:
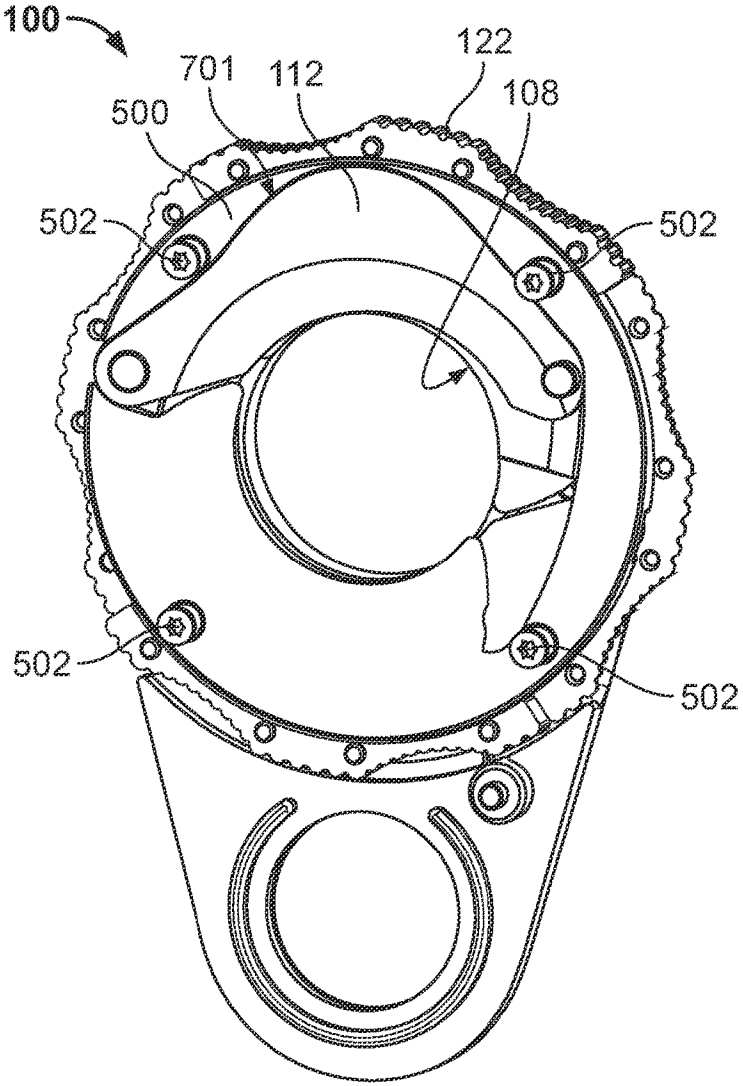
FIGS. 8 and 9 show the same views as FIGS. 6 and 7, respectively, with the example blades in the open position.

FIG. 7 shows the same view of the example cigar cutter 100 as FIG. 6 with the first wheel plate 602 removed. As shown in FIG. 7, the mounting plate 500 is disposed in the wheel 122. The wheel 122 is rotatable around or about the mounting plate 500. As shown in FIG. 7, the first blade 112 is rotatably coupled to the mounting plate 500 at the first point 516 (e.g., via the first post 522). A shown in FIG. 7, the first side 518 of the mounting plate 500 has a first recess 701 that is shaped to receive the first blade 112. When the first blade 112 is moved to the open position (as shown in FIG. 9), the first blade 112 is moved into the first recess 701. The recess 701 enables to the first blade 112 to remain close to a central plane of the cigar cutter 100 and, thus, reduces the overall thickness of the cigar cutter 100.

In some examples, the cigar cutter 100 includes bearings 700 (one of which is referenced in FIG. 7) between an outer surface 702 of the mounting plate 500 and an inner surface 704 of the wheel 122 (e.g., the inner surface 704 of the ring 606). The bearings 700 enable the wheel 122 to rotate smoothly around the mounting plate 500. In this example, the bearings 700 are rollers or needles. In other examples, other types of bearings can be implemented, such as ball bearings.

Figure 8:
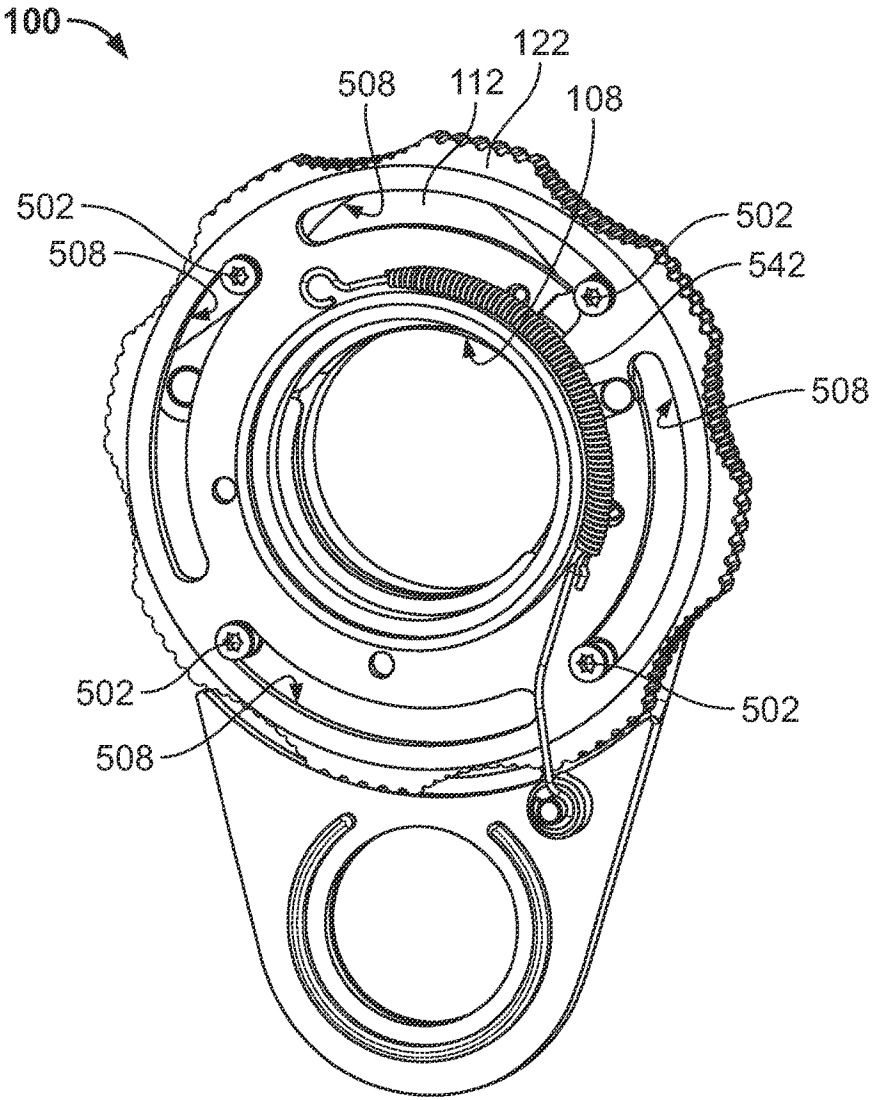

FIGS. 8 and 9 show the same views of the cigar cutter 100 as FIGS. 6 and 7, respectively, after the wheel 122 has been rotated in the counter-clockwise (first) direction. As such, the wheel 122 has rotated the first blade 112 away from the opening 108 to the open position. As shown in FIG. 9, the first blade 112 is in the first recess 701 of the mounting plate 500. In some examples, when the wheel 122 is in the fully open position, the first threaded fasteners 502 are engaged with the ends of the slots 508, which prevents the wheel 122 from being further rotated. Therefore, in some examples, the slots 508 and the first threaded fasteners 502 form stops or limits that define the fully open and closed positions. While in this example there are four threaded fasteners 502 and four slots 508, in other examples, the cigar cutter 100 may include more or fewer threaded fasteners and slots.

Also, as shown in FIG. 8, the spring 542 has been stretched lengthwise, which creates tension in the spring 542. When the wheel 122 is released, the spring 542 contracts to rotate the wheel 122 in the clockwise (second) direction, thereby moving the first blade 112 back toward the opening 108 and toward the closed position. The wheel 122 is stopped when the ends of the slots 508 engage the first threaded fasteners 502, as shown in the position in FIG. 6.

Figure 10:
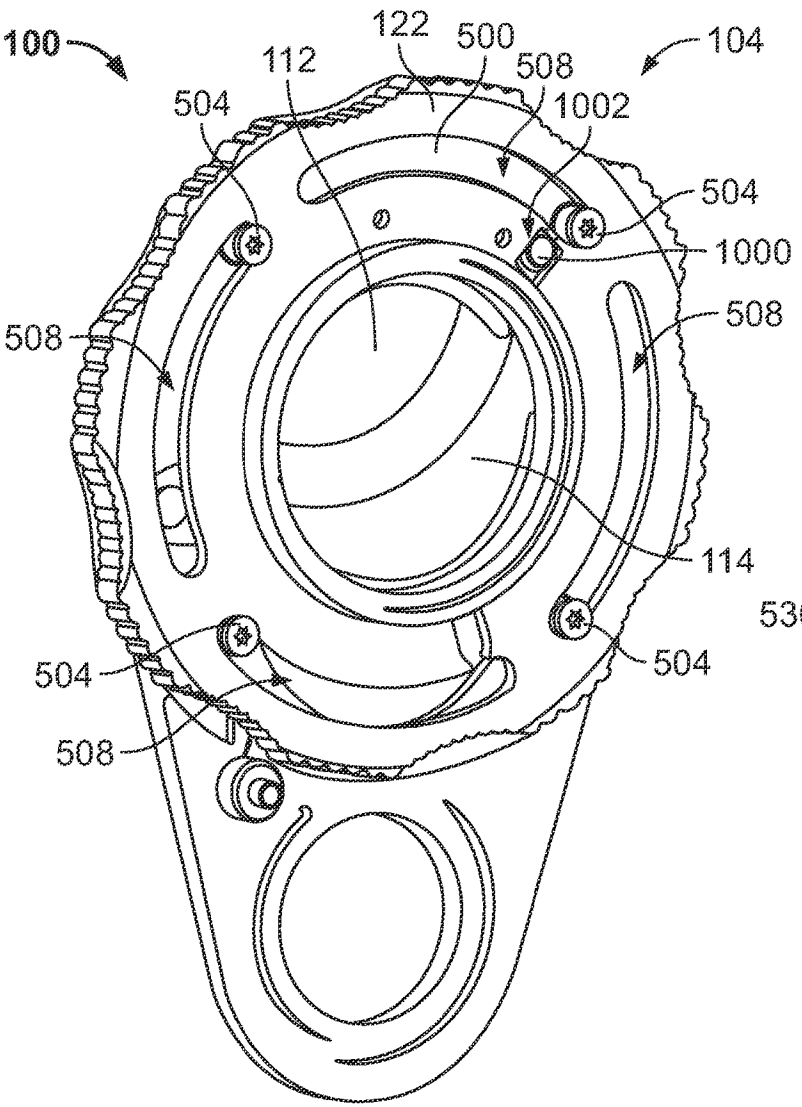
FIG. 10 is a perspective view of the first side of the example cigar cutter of FIG. 1 with the example blades in the closed position.

FIG. 10 shows the second side 104 of the cigar cutter 100 with the second plate 118 (FIG. 1) removed. In FIG. 10, the blades 112, 114 are in the closed position. As shown in FIG. 10, the second threaded fasteners 504 extend through respective ones of the slots 508 in the wheel 122 and into the mounting plate 500 (which is disposed in the wheel 122). Similar to the first threaded fasteners 502 (FIG. 6), the second threaded fasteners 504 are engaged with the ends of the slots 508, thereby forming the limit in the closed position. In the illustrated example, the second blade 114 has a second post 1000 that is disposed in a second notch 1002 formed in the wheel 122. When the wheel 122 rotates, the wheel 122 moves the second post 1000 (e.g., along an arcuate path), such that the second blade 114 is rotated about the second point 530. In other examples, the second blade 114 can be coupled to the wheel 122 in other manners (e.g., a threaded fastener, friction fit, an adhesive, etc.).

Figure 11:
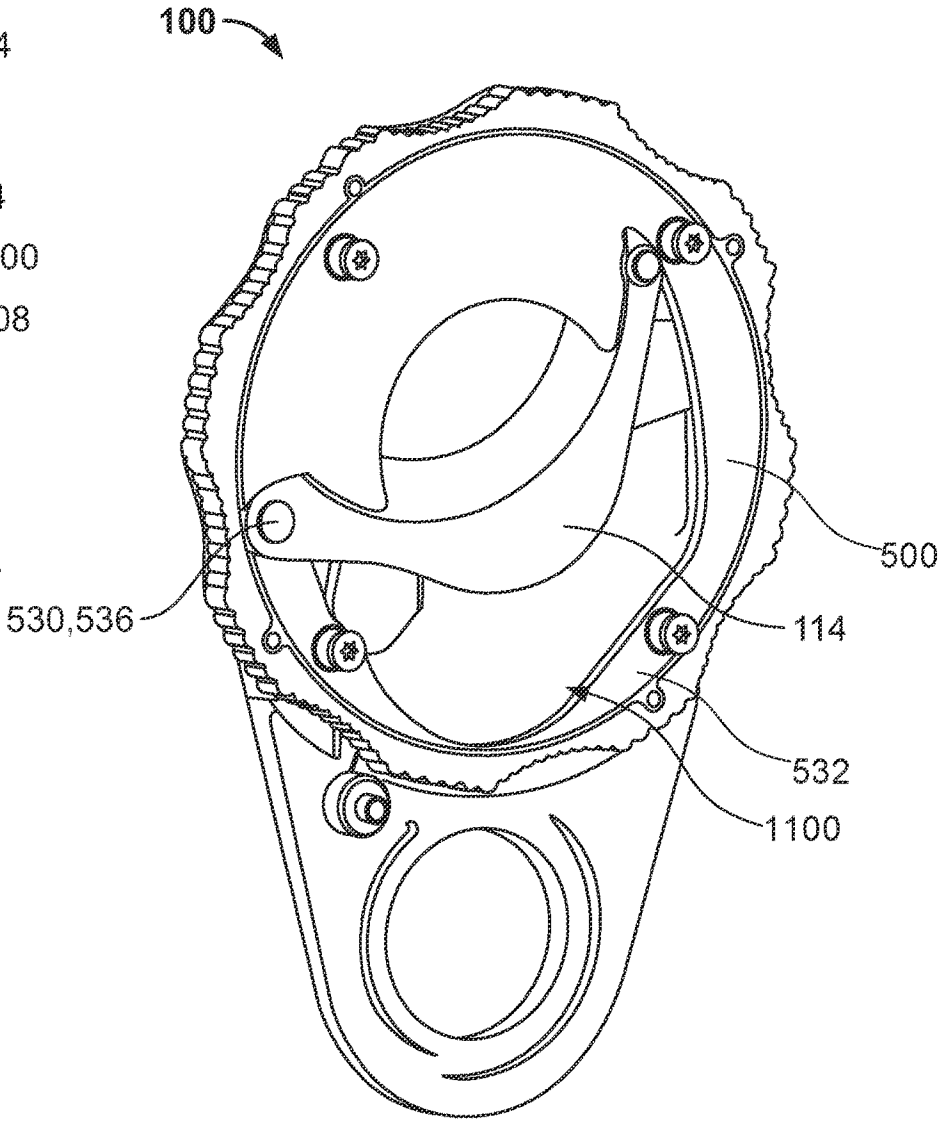
FIG. 11 is a perspective view of the first side of the example cigar cutter of FIG. 1 with the example blades in the closed position.

FIG. 11 shows the same view of the example cigar cutter 100 as FIG. 10 with the second wheel plate 604 (FIG. 6) removed. As shown in FIG. 11, the second blade 114 is rotatably coupled to the mounting plate 500 at the second point 530 (e.g., via the second post 536). Similar to the first side 518 of the mounting plate 500, the second side 532 of the mounting plate 500 has a second recess 1100 to receive the second blade 114 when the second blade 114 is moved to the open position (as shown in FIG. 13).

Figure 13:
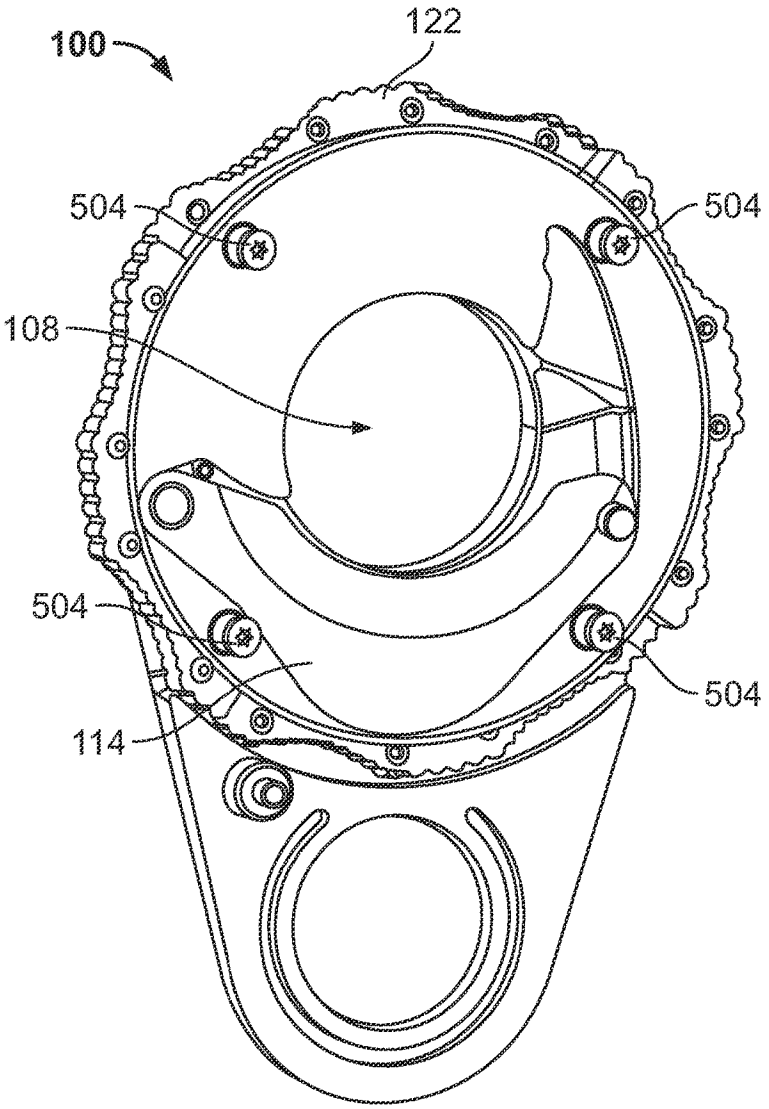
FIGS. 12 and 13 show the same views as FIGS. 10 and 11, respectively, with the example blades in the open position.
Figure 12:
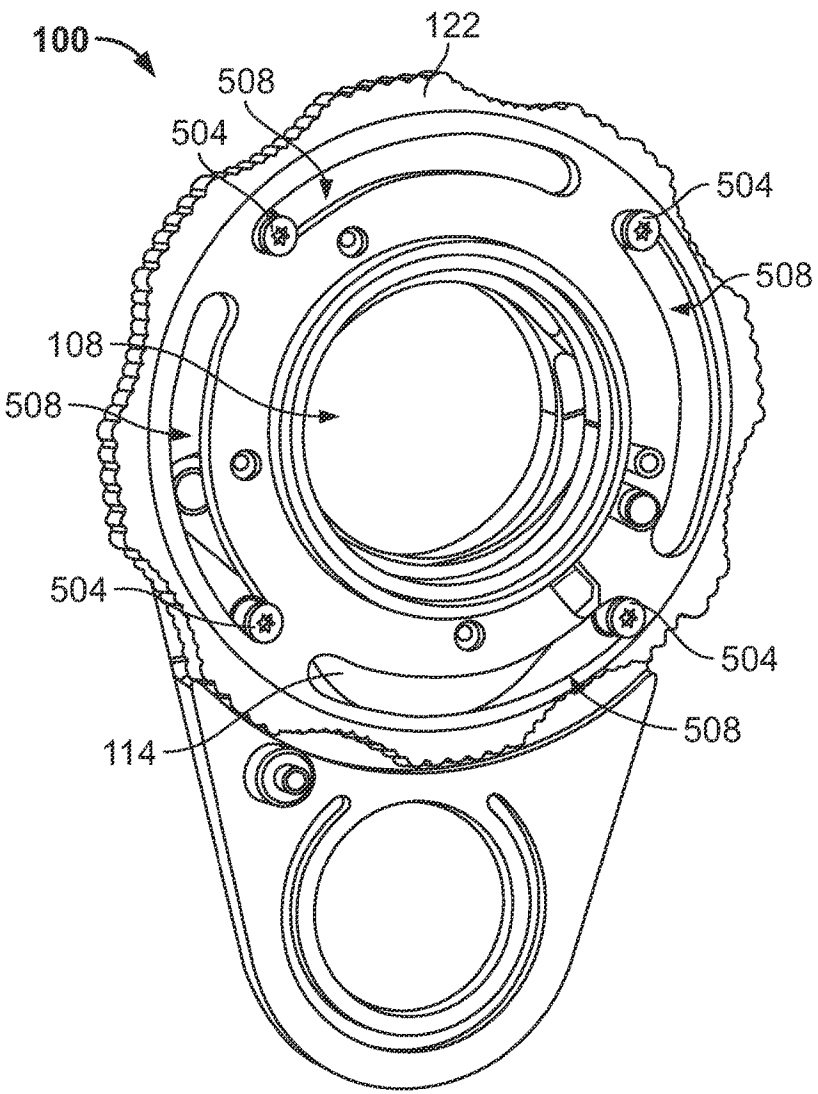

FIGS. 12 and 13 show the same views of the cigar cutter 100 as FIGS. 10 and 11, respectively, after the wheel 122 has been rotated in the clockwise (second) direction. As such, the wheel 122 has rotated the second blade 114 away from the opening 108 to the open position. In some examples, when the wheel 122 is in the fully open position, the second threaded fasteners 504 are engaged with the ends of the slots 508, which prevents the wheel 122 from being further rotated. Therefore, in some examples, the slots 508 and the second threaded fasteners 504 form stops or limits that define the fully open and closed positions. In other examples, the cigar cutter 100 can include other structures that form stops or limits to define the full open and closed positions. While in this example there are four threaded fasteners 504 and four slots 508, in other examples, the cigar cutter 100 may include more or fewer threaded fasteners and slots.

In the illustrated example, the wheel 122 is rotatable between a first position (as shown in FIGS. 6 and 10) corresponding to the closed position of the blades 112, 114, and a second position (as shown in FIGS. 8 and 12) corresponding to the open position for the blades 112, 114. Rotation of the wheel 122 between the first position and the second position moves the blades 112, 114. Rotation of the wheel 122 between the first position and the second position moves the first blade 112 in a first direction and moves the second blade in a second direction different than (e.g., opposite of) the first direction. In some examples, the cigar cutter 100 includes a biasing element, such as the spring 542, to bias the wheel 122 toward one of the first position or the second position. In the illustrated example, the spring 542 is configured to bias the wheel 122 toward the first position.

While in the illustrated example the wheel 122 is a complete wheel (360°), in other examples, the wheel 122 can be implemented by only a portion of a wheel. For example, the actuation mechanism 120 can include a circular sector that can be implemented as the wheel 122. The circular sector can rotate similar to the wheel 122 to provide the actuation actions.

While in the illustrated example the cigar cutter 100 includes two blades, in other examples, the cigar cutter 100 may only include one blade (e.g., only the first blade 112). In such an example, the blade may fully move into the opening 108 to provide the cutting action. In some examples, a fixed blade is provided (e.g., on the opposite side of the opening 108), and the moveable blade moves relative to the fixed blade. In other examples, the cigar cutter 100 can include more than two blades. For example, the cigar cutter can include four blades.

In some examples, the actuation mechanism 120 is manually operated by a user. Additionally or alternatively, the cigar cutter 100 can include a motor (e.g., an electric motor) to operate the actuation mechanism to automatically open and/or close the blade 112, 114. The motor can be disposed in the body and operatively coupled (e.g., directly or via one or more gears) to the wheel 122 and/or another component for moving the blades 112, 114. When activated, the motor can rotate the wheel 122 in the first direction or the second direction to automatically open or close the blades 112, 114. In some examples, the cigar cuter 100 includes a battery (e.g., a rechargeable battery) in the body 106 for powering the electric motor. In some examples, the cigar cutter 100 can include an interface component (e.g., a button, a switch, etc.) on the body 106 that can be activated by the user. When the user activates the interface component, the motor is activated to open or close the blades 112, 114.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects and/or things, the phrase "at least one of A and B" is intended to refer to implementations including any of (1) at least one A, (2) at least one B, or (3) at least one A and at least one B. Similarly, as used herein in the context of describing structures, components, items, objects and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, or (3) at least one A and at least one B.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements or method actions may be implemented by, e.g., the same entity or object. Additionally, although individual features may be included in different examples or claims, these may possibly be combined, and the inclusion in different examples or claims does not imply that a combination of features is not feasible and/or advantageous.

From the foregoing, it will be appreciated that example cigar cutters have been disclosed that use a rotating action to provide a cut. Example cigar cutters disclosed herein include a rotatable mechanism can be rotated in one direction to open the blades and rotated in an opposite direction to close the blades. The rotatable actuation mechanism can be biased (e.g., spring loaded), such that the actuation mechanism automatically rotates to close the blades and assist in the cutting force. Thus, some example cigar cutters disclosed herein do not include the handles or utilize the linear action of known cigar cutters. Example cigar cutters have also been disclosed that include a stabilization feature, such as, for example, an opening to receive a finger of the user when holding the cigar cutter.

Examples and example combinations disclosed herein include the following:

Example 1 is a cigar cutter comprising a body having an opening to receive a cigar, and a first blade and a second blade that are moveable relative to the opening in the body. The first and second blades are moveable between an open position and a closed position. The cigar cutter also includes a wheel rotatably coupled to the body. When the wheel is rotated in a first direction, the first and second blades are moved to the open position, and when the wheel is rotated in a second direction opposite the first direction, the first and second blades are moved to the closed position.

Example 2 includes the cigar cutter of Example 1, wherein the wheel is coaxial with the opening.

Example 3 includes the cigar cutter of Examples 1 or 2, further including a spring to bias the wheel in the second direction.

Example 4 includes the cigar cutter of any of Examples 1-3, further including a mounting plate coupled to the body. The first blade is rotatably coupled to the mounting plate at a first point, and the second blade is rotatably coupled to the mounting plate at a second point.

Example 5 includes the cigar cutter of Example 4, wherein the first point is on a first side of the mounting plate and the second point is on a second side of the mounting plate opposite the first side.

Example 6 includes the cigar cutter of Examples 4 or 5, wherein the first blade has a first post disposed in a first notch formed in the wheel, such that when the wheel is rotated, the first blade is rotated about the first point.

Example 7 includes the cigar cutter of Example 6, wherein the second blade has a second post disposed in a second notch formed in the wheel, such that when the wheel is rotated, the second blade is rotated about the second point.

Example 8 includes the cigar cutter of any of Examples 4-7, wherein the mounting plate is disposed in the wheel, and the wheel is rotatable about the mounting plate.

Example 9 includes the cigar cutter of Example 8, wherein the body includes a first plate forming a first side of the cigar cutter and a second plate forming a second side of the cigar cutter. The wheel is disposed between the first and second plates.

Example 10 includes the cigar cutter of Example 9, wherein the mounting plate is coupled to the first plate via first threaded fasteners. The first threaded fasteners extend through respective slots in the wheel. The slots enable the wheel to rotate relative to the mounting plate without abutting the first threaded fasteners.

Example 11 includes the cigar cutter of any of Examples 1-10, wherein a portion of an outer peripheral edge of the wheel extends beyond the body, and wherein the outer peripheral edge of the wheel has at least one groove.

Example 12 includes the cigar cutter of any of Examples 1-11, wherein the opening is a first opening. The body has a second opening to receive a finger of a user while holding the cigar cutter.

Example 13 includes the cigar cutter of Example 12, wherein the second opening has a central axis that is parallel to and offset from a central axis of the first opening.

Example 14 is a cigar cutter comprising a body defining an opening to receive a cigar, a first blade rotatably coupled to the body, a second blade rotatably coupled to the body, and a wheel to, when rotated in a first direction, rotate the first and second blades away from each other and, when rotated in a second direction opposite the first direction, rotate the first and second blades toward each other.

Example 15 includes the cigar cutter of Example 14, further comprising a spring to bias the wheel in the second direction.

Example 16 includes the cigar cutter of Example 15, wherein the spring is coupled between a first mount coupled to the wheel and a second mount coupled to the body.

Example 17 is a cutting device comprising a body having an opening to receive an object to be cut, a blade rotatably coupled to the body, and a wheel rotatably coupled to the body. The wheel is rotatable between a first position and a second position, wherein rotation of the wheel between the first position and the second position moves the blade.

Example 18 includes the cutting device of Example 17, further comprising a biasing element to bias the wheel toward one of the first position or the second position.

Example 19 includes the cutting device of Examples 17 or 18, wherein the blade is a first blade. The cutting device includes a second blade rotatably coupled to the body, wherein rotation of the wheel between the first position and the second position moves the second blade.

Example 20 includes the cutting device of Example 19, wherein rotation of the wheel between the first position and the second position moves the first blade in a first direction and moves the second blade in a second direction different than the first direction.

Although certain example systems, methods, apparatus, and articles of manufacture have been disclosed herein, the scope of coverage of this patent is not limited thereto. On the contrary, this patent covers all systems, methods, apparatus, and articles of manufacture fairly falling within the scope of the claims of this patent.

The following claims are hereby incorporated into this Detailed Description by this reference, with each claim standing on its own as a separate embodiment of the present disclosure.

What is claimed is:

1. A cigar cutter comprising:

a body having an opening to receive a cigar;

a first blade and a second blade that are moveable relative to the opening in the body, the first and second blades moveable between an open position and a closed position;

a mounting plate coupled to the body, the first blade rotatably coupled to the mounting plate at a first point, the second blade rotatably coupled to the mounting plate at a second point; and a wheel rotatably coupled to the body, the mounting plate disposed in the wheel, the wheel rotatable about the mounting plate, wherein, when the wheel is rotated in a first direction, the first and second blades are moved to the open position, and when the wheel is rotated in a second direction opposite the first direction, the first and second blades are moved to the closed position, and wherein the body includes a first plate forming a first side of the cigar cutter and a second plate forming a second side of the cigar cutter, the wheel disposed between the first and second plates.

2. The cigar cutter of claim 1, wherein the wheel is coaxial with the opening.

3. The cigar cutter of claim 1, further including a spring to bias the wheel in the second direction.

4. The cigar cutter of claim 1, wherein the first point is on a first side of the mounting plate and the second point is on a second side of the mounting plate opposite the first side.

5. The cigar cutter of claim 1, wherein the first blade has a first post disposed in a first notch formed in the wheel, such that when the wheel is rotated, the first blade is rotated about the first point.

6. The cigar cutter of claim 5, wherein the second blade has a second post disposed in a second notch formed in the wheel, such that when the wheel is rotated, the second blade is rotated about the second point.

7. The cigar cutter of claim 1, wherein the mounting plate is coupled to the first plate via first threaded fasteners, the first threaded fasteners extending through respective slots in the wheel, the slots to enable the wheel to rotate relative to the mounting plate without abutting the first threaded fasteners.

8. The cigar cutter of claim 1, wherein a portion of an outer peripheral edge of the wheel extends beyond the body, and wherein the outer peripheral edge of the wheel has at least one groove.

9. The cigar cutter of claim 1, wherein the opening is a first opening, the body having a second opening to receive a finger of a user while holding the cigar cutter.

10. The cigar cutter of claim 9, wherein the second opening has a central axis that is parallel to and offset from a central axis of the first opening.

11. A cigar cutter comprising:

a body defining an opening to receive a cigar;

a first blade rotatably coupled to the body;

a second blade rotatably coupled to the body;

a wheel to, when rotated in a first direction, rotate the first and second blades away from each other and, when rotated in a second direction opposite the first direction, rotate the first and second blades toward each other, the wheel having an outer peripheral edge, a portion of the outer peripheral edge extending beyond the body to enable a user to grip the outer peripheral edge and rotate the wheel, the wheel having an arc-shaped slot; and a threaded fastener extending through a portion of the body and into the slot, the threaded fastener to engage ends of the slot to limit rotational movement of the wheel in the first direction and the second direction.

12. The cigar cutter of claim 11, further comprising a spring to bias the wheel in the second direction.

13. The cigar cutter of claim 12, wherein the spring is coupled between a first mount coupled to the wheel and a second mount coupled to the body.

14. The cigar cutter of claim 11, wherein the outer peripheral edge has a plurality of grooves.

* * * * *